United States Patent [19]

Jeffrey

[11] 4,450,831

[45] May 29, 1984

[54] SELF SUPPORTING MOUTH SPECULUM FOR HORSES, MULES, AND OTHER ANIMALS

[76] Inventor: Louis D. Jeffrey, 14805 Branched Oak Rd., Waverly, Nebr. 68462

[21] Appl. No.: 345,138

[22] Filed: Feb. 2, 1982

[51] Int. Cl.[3] ..... A61D 15/00

[52] U.S. Cl. ..... 128/14; 128/3

[58] Field of Search ..... 128/3, 14, 17–19

[56] References Cited

U.S. PATENT DOCUMENTS 523,811 7/1894 Harris ..... 128/14

1,130,346 3/1915 Swales ..... 128/14

*Primary Examiner*—Lee S. Cohen

*Assistant Examiner*—Angela D. Sykes

*Attorney, Agent, or Firm*—Zarley, McKee, Thomte, Voorhees & Sease

[57] ABSTRACT

An improved self-supporting mouth speculum for horses or the like comprising first and second cheek hooks adjustably connected together by a pair of straps extending therebetween. The first cheek hook includes a ring having a U-shaped hook portion extending therefrom which is inserted into one side of the horse's mouth. The second cheek hook comprises a ring having a U-shaped member extending therefrom which has a spreader portion secured thereto which is positioned between the rear molars at the other side of the horse's mouth. The adjustable straps extend over the poll of the horse behind the ears and may be tightened to maintain the entire speculum in position.

1 Claim, 4 Drawing Figures

SELF SUPPORTING MOUTH SPECULUM FOR HORSES, MULES, AND OTHER ANIMALS

BACKGROUND OF THE INVENTION

This invention relates to an improved self-supporting mouth speculum for examining the mouth of a horse, mule, or other animals.

SUMMARY OF THE INVENTION

The self-supporting mouth speculum of this invention comprises a first cheek hook connected to a second cheek hook by means of an adjustable strap extending therebetween. The first cheek hook is first inserted into the horse's mouth thereby causing the horse to begin to open its mouth. The strap is extended around the horse's head and the second cheek hook is inserted into the other side of the horse's mouth. The strap is then adjusted to the proper tension thereby maintaining the speculum which is secured to the second cheek hook to be held in place. The speculum is positioned between the upper and lower teeth of the horse's mouth to maintain the horse's mouth in an open condition.

DESCRIPTION OF THE PREFERRED EMBODIMENT

Figure 3:
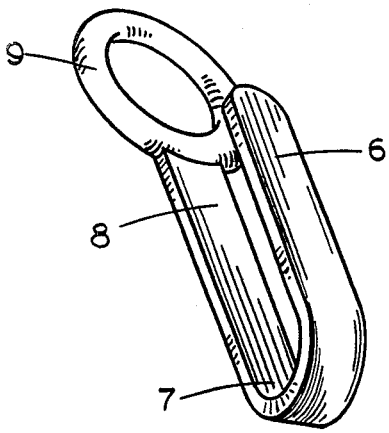
FIG. 3 is a perspective view of the first cheek hook.
Figure 4:
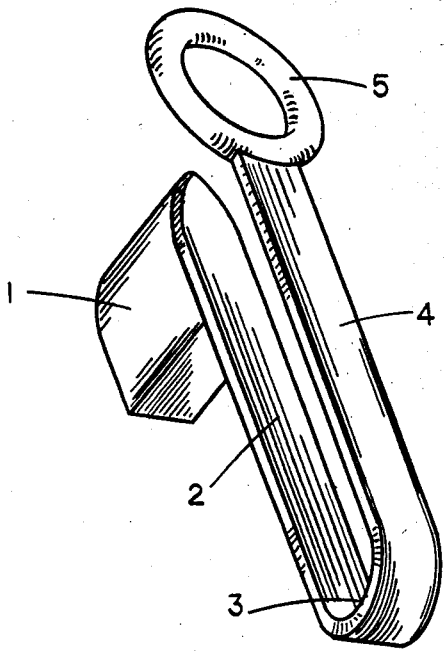
FIG. 4 is a perspective view of the second cheek hook.

Referring to the drawings, the letter A refers to the off-side hook or first cheek hook while the letter B refers to the on-side hook or second cheek hook. Cheek hook A includes a ring 9 having an outer bar 8 secured thereto and extending therefrom which terminates in portion 7. Bar 6 extends from portion 7 as illustrated in FIG. 3.

Figure 2:
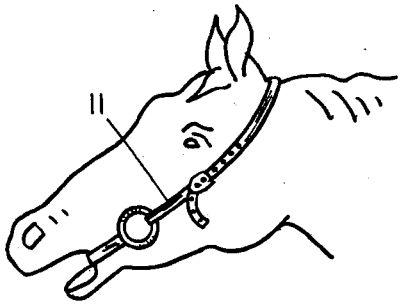
FIG. 2 is a side view opposite to that of FIG. 1.

The second cheek hook or on-side hook B includes a ring 5 having a flat bar 4 extending therefrom which terminates in an arcuate portion 3 or hook area which has bar 2 extending therefrom as illustrated in FIG. 2. the numeral 1 refers to a round mouth piece secured to the end of bar 2 which is set at an angle for easy insertion into the mouth and acts as a spreader between the rear molars of the horse.

Figure 1:
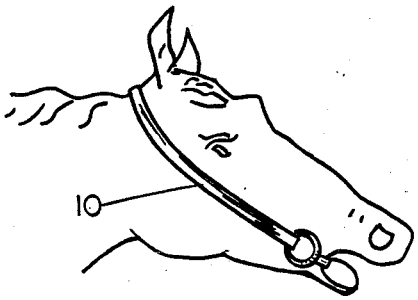
FIG. 1 is a side view of the invention illustrating the invention secured to the horse.

A short strap 11 is secured to the ring 5 and a longer strap 10 is secured to the ring 9. Straps 10 and 11 are adjustably secured together in conventional fashion. In use, the cheek hook A is inserted into the animal's mouth so that the bar 6 is positioned inside the animal's mouth and the ring 9 is positioned adjacent the outside of the horse's mouth as illustrated in FIG. 1. The insertion of the first cheek hook A causes the horse to begin to open his mouth thereby making it easier for the handler to install the cheek hook B. The round mouth piece 1 is positioned between the rear molars and causes the horse's mouth to be opened. The ring 5 on hook B keeps the rear molars in line during the insertion of the cheek hook B into the mouth. The cheek hook B is positioned relative to the horse's mouth as illustrated in FIG. 2. The strap 10 extends around the poll of the horse just behind the ears and the straps are adjusted or tightened to maintain the entire speculum in position. When tightened, the straps maintain the speculum in the proper tension thereby maintaining the same in place and eliminating the danger of the speculum slipping out of position. The positive positioning of the speculum frees the handler from accidental biting from the horse. One man may easily do the entire operation of examining the horse's mouth. One of the assets of the cheek hook A is that it can be pulled slightly out and towards the side after installation for easier access to the mouth.

I claim:

1. A self-supporting mouth speculum for horses and the like, comprising, a first U-shaped cheek hook portion for insertion into one corner of the horse's mouth, a second U-shaped hook portion for insertion into the other corner of the horse's mouth, said second U-shaped hook portion having a spreader portion thereon which is adapted to be positioned between the upper and lower rear molars of the horse's teeth when said second U-shaped hook portion is inserted into the horse's mouth, and an adjustable strap means secured to and extending between said first and second cheek hook portions for extension around the horse's head to maintain said cheek hook portion in position.

* * * * *